United States Patent [19]

Yamaguchi et al.

[11] Patent Number: 4,506,722

[45] Date of Patent: Mar. 26, 1985

[54] METHOD OF AND APPARATUS FOR CASTING SPHERICAL METAL LUMPS

[75] Inventors: Terumoto Yamaguchi, Anjo; Tsuneo Terajima, Nagoya, both of Japan

[73] Assignee: Kabushiki Kaisha Tokai Rika Denki Seisakusho, Aichi, Japan

[21] Appl. No.: 413,068

[22] Filed: Aug. 30, 1982

Related U.S. Application Data

[63] Continuation of Ser. No. 155,091, Jun. 2, 1980, abandoned.

[30] Foreign Application Priority Data

Jun. 7, 1979 [JP] Japan ..... 54-71545
May 19, 1980 [JP] Japan ..... 55-66277

[51] Int. Cl.[3] ..... B22D 5/02; B22D 13/04
[52] U.S. Cl. ..... 164/130; 164/325; 164/327; 164/336; 164/339
[58] Field of Search ..... 164/322-325, 164/330, 336, 339, 130, 327

[56] References Cited

U.S. PATENT DOCUMENTS

| | | | |
|---|---|---|---|
| 90,318 | 5/1869 | Smith | 164/325 X |
| 390,355 | 10/1888 | Fawcett | 164/325 |
| 1,350,352 | 8/1920 | Anderson | 164/325 |
| 3,709,288 | 1/1973 | Lemieux | 164/325 |

FOREIGN PATENT DOCUMENTS

| | | | |
|---|---|---|---|
| 84917 | 5/1976 | Australia | 164/336 |
| 44-31324 | 12/1969 | Japan | 164/336 |
| 312302 | 12/1955 | Switzerland | 164/325 |

*Primary Examiner*—Nicholas P. Godici
*Assistant Examiner*—J. Reed Batten, Jr.
*Attorney, Agent, or Firm*—Wenderoth, Lind & Ponack

[57] ABSTRACT

A casting apparatus for casting a spherical metal lumps which includes a plurality of casting molds provided around an intermittent rotary member so as to radially outwardly extend from the rotary member, a control member to successively close the casting molds at an upper position and a position before the upper position in the rotational path of the casting molds and to open the casting molds at a lower position of the rotational path, and a molten metal pouring funnel provided at the upper position for pouring molten metal into the casting molds.

11 Claims, 18 Drawing Figures

METHOD OF AND APPARATUS FOR CASTING SPHERICAL METAL LUMPS

This is a continuation application of Application Ser. No. 155,091, filed June 2, 1980, now abandoned.

BACKGROUND OF THE INVENTION

The present invention generally relates to a casting machine, and more particularly, to a casting apparatus capable of manufacturing, with an extremely high efficiency, small-sized spherical metal lumps or ingots suitable for being supplied, for example, into a metal melting pot for a die-casting machine, type casting machine or the like through rolling movement of the metal lumps over a supply trough.

Commonly, spherical metal lumps or ingots may be fed into the metal melting pot through rolling movement thereof, and therefore, are extremely advantageous as compared with the case where rectangular ingots are supplied through sliding, since there is no possibility of accumulation of the metal lumps during feeding of such spherical metal lumps. However, molten metal generally shrinks in its volume during solidification, and thus, in the conventional spherical metal lump casting machines, when molten metal is injected through pouring gates into spherical cavities formed in casting molds for subsequent cooling, sink marks or shrink marks which open toward the spherical surfaces of the metal lumps are formed, and the openings of such shrink marks hinder smooth rolling of the spherical metal lumps during feeding. Moreover, if voids due to such shrinkage are formed within the spherical metal lumps during the solidification so as to allow entry of external air thereinto, there are such dangers that the air contained in the voids is heated and expands upon feeding of the metal lumps into the metal melting pot so as to cause explosions or that the molten metal in the pot is brought into a boiling state.

SUMMARY OF THE INVENTION

Accordingly, an essential object of the present invention is to provide an improved casting apparatus which is capable of automatically casting spherical metal lumps or ingots the surfaces of which are covered with approximately spherical chilled layers and which have voids filled with thin air formed therein by contraction and expansion of molten metal.

Another important object of the present invention is to provide an improved casting apparatus of the above described type which is further equipped with a molten metal feeding device capable of most rationally supplying the molten metal into pouring gates for the spherical casting cavities provided in the casting molds.

A further object of the present invention is to provide an improved casting apparatus of the above described type which has a simple construction and functions accurately with high reliability, and can be readily manufactured at low cost.

In accomplishing these and other objects according to one preferred embodiment of the present invention, there is provided a casting apparatus for casting metal lumps which includes a support frame, an intermittent rotary member rotatably supported by said support frame, a plurality of casting molds extending radially outwardly from said intermittent rotary member, each of said casting molds including a pair of mold halves which separate in a radial direction, each metal mold having a spherical cavity therein and corresponding short pouring gates extending outwardly from and communicated with said spherical cavity, with a base portion of each of said pair of the mold halves being pivotally supported by said intermittent rotary member, an open and close control member for successively closing said pairs of mold halves selectively at a top position and a position prior to said top position in the rotational path of said molds and to open said mold halves at a lower position in said rotational path, and a molten metal pouring funnel fixedly provided at said top position of the rotational path and arranged to be communicated with the successive short pouring gates for pouring the molten metal into said cavities.

By the arrangement of the present invention as described above, an improved casting apparatus for casting spherical metal lumps with high efficiency has been advantageously presented, with substantial elimination of disadvantages inherent in the conventional casting apparatus of this kind.

BRIEF DESCRIPTION OF THE DRAWINGS

These and other objects and features of the present invention will become apparent from the following description of the preferred embodiments thereof and with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
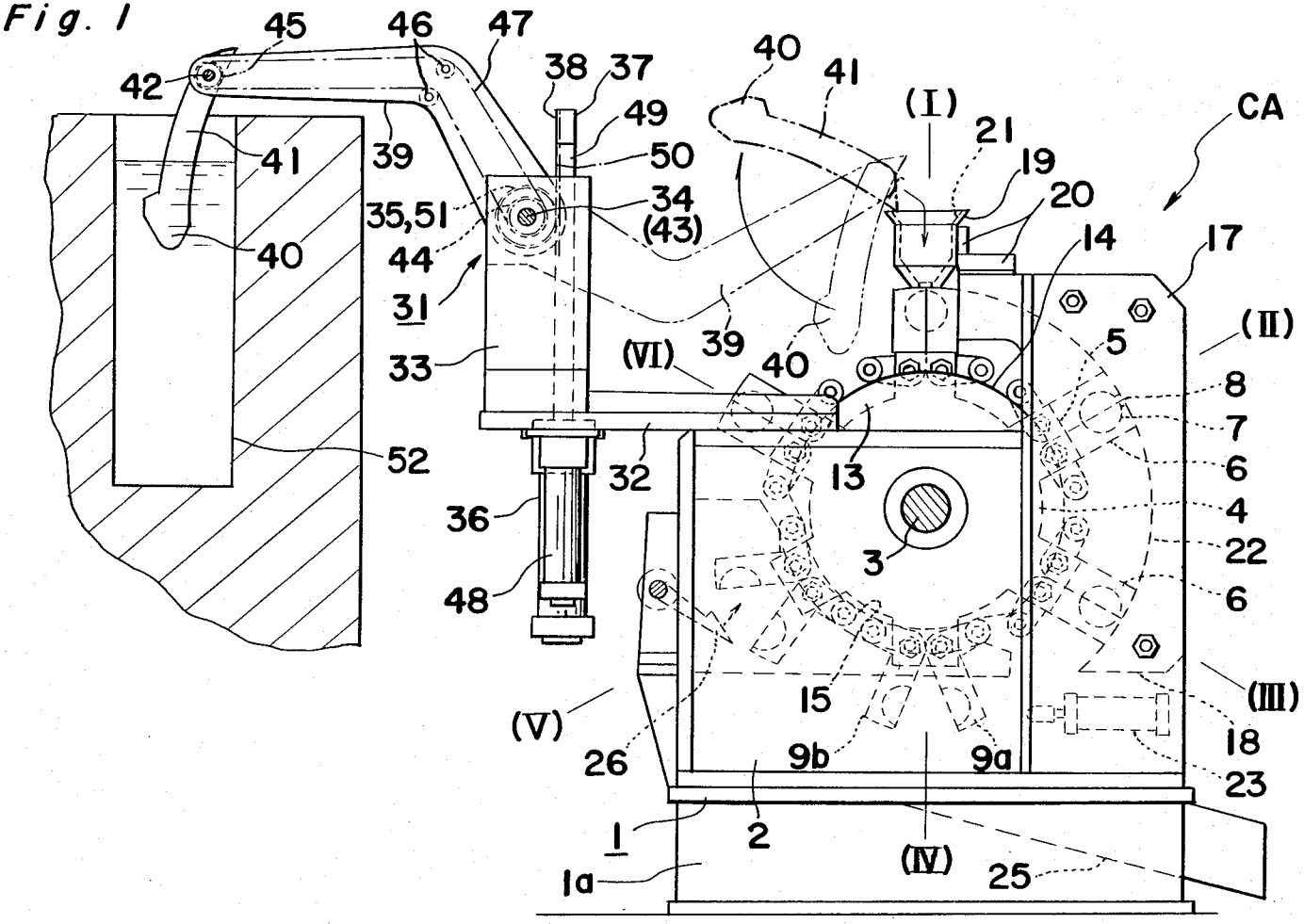
FIG. 1 is a schematic side elevational view showing the construction of a casting apparatus according to a first embodiment of the present invention including a molten metal feeding device.
Figure 2:
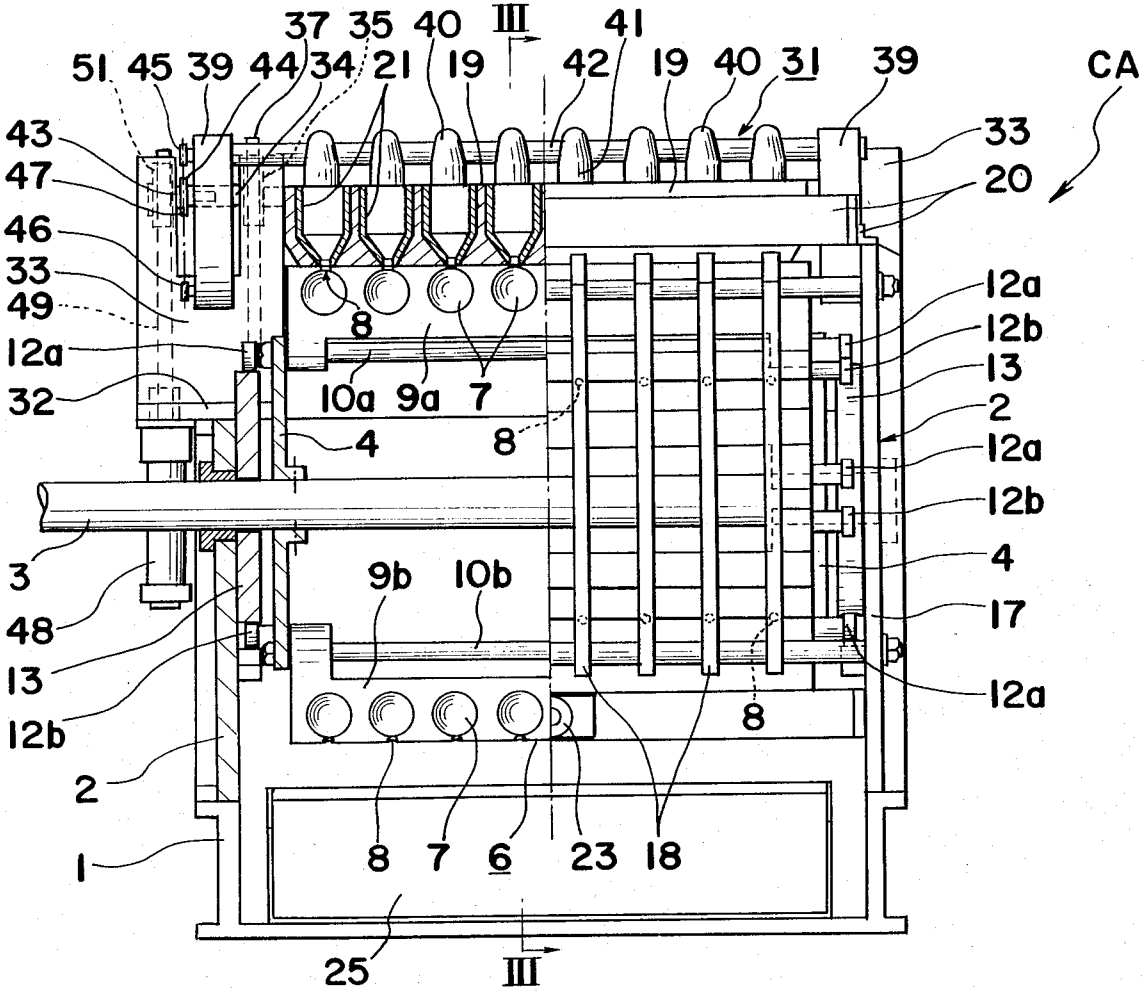
FIG. 2 is a front elevational view showing, partly in section and on an enlarged scale, the important portion of the apparatus of FIG. 1.
Figure 3:
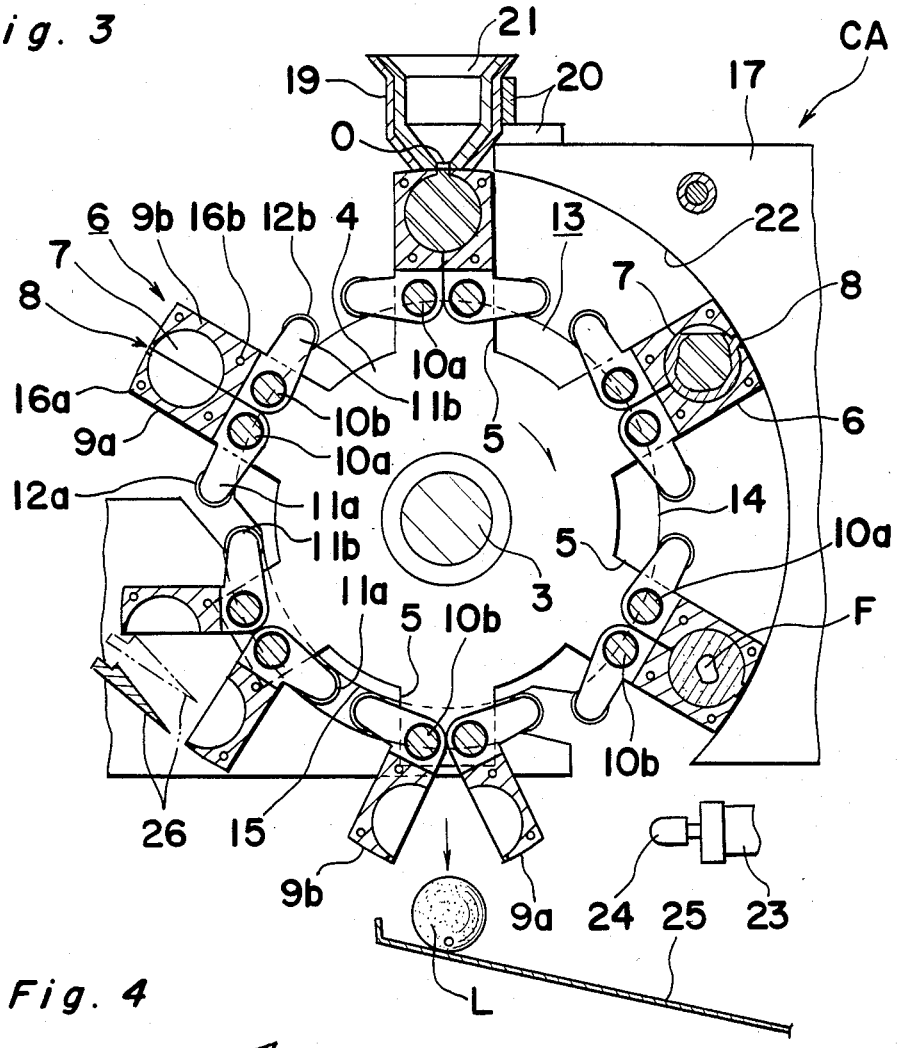
FIG. 3 is a sectional view taken along the line III—III of FIG. 2.

Referring now to the drawings, there is shown in FIGS. 1 to 3 a casting apparatus CA according to one preferred embodiment of the present invention which includes a support frame 1 having side walls 2 secured to opposite forward side edges of a base 1*a* so as to confront to each other, an intermittent rotary shaft 3 horizontally extending through said side walls 2 to be rotatably supported thereby for intermittent rotation through 60° at each actuation thereon and subsequent stopping, for example, by a geneva gear mechanism or the like (not shown), cam plates 13 respectively fixed to corresponding inner surfaces of the side walls 2 in coaxial relation with the rotary shaft 3, and rotary discs 4 fixedly mounted on the rotary shaft 3 in positions slightly inwardly of the side walls 2 from the cam plates 13, each of which rotary discs 4 has projections 5 radially outwardly extending therefrom and spaced at an angular interval of 60° to divide the circumference of the rotary discs 4 into six equal parts as shown in FIG. 3. Between the projections 5 of the corresponding rotary discs 4, there are provided casting molds 6 each arranged to further extend radially outwardly from said projections 5 and having formed therein a plurality of (eight in this embodiment) spherical casting cavities 7 spaced at regular intervals in the direction parallel to the axis of the intermittent rotary shaft 3 and also with corresponding pouring gates 8 outwardly extending from respective spherical cavities 7 for communication therewith. Each of the casting molds 6 comprises a pair of mold halves 9*a* and 9*b* which are split in the radial direction and which define therebetween said spherical cavities 7, and pouring gates 8, and the base portions of each pair of said mold halves are pivotally supported by shafts 10*a* and 10*b* extending between corresponding projections 5. The mold halves 9*a* and 9*b* further include arm portions 11*a* and 11*b* laterally symmetrically extending from the base portions thereof and having contact rollers 12*a* and 12*b* rotatably provided at their distal ends for contact with the peripheral surfaces of the cam plates 13. Each of the cam plates 13 has a large diameter portion 14 and a small diameter portion or recesses 15 for control so as to close the mold halves 9*a* and 9*b* at respective stopping positions (VI), (I), (II) and (III) and to open said mold halves to angles of 35° to 45° to each other at respective stopping positions of (IV) and (V) of the casting molds 6 (FIG. 1). For cooling purposes, the mold halves 9*a* and 9*b* are respectively provided with cooling water passages 16*a* and 16*b* formed therein.

As shown in FIG. 1, the stopping position (I) is located at a top position in the rotational path of the casting molds 6, and in said top position, there is provided a funnel support member 19 secured by fixing pieces 20 onto a front protruding portions at the upper edge of blocking plates 18 which are held between second side walls 17 extending upwardly from the opposite rear side edges of the base 1*a*. A heat resistant molten metal pouring funnel 21 is fitted into the support member 19, opposite each mold 6 and the short pouring gates 8 of the spherical cavities 7 for the casting molds 6 which are successively rotated towards the stopping angle (I) and stopped thereat are brought into alignment with a lower opening O of the corresponding funnel 21. Meanwhile, each blocking plate 18 is provided with a concave arcuate rear wall 22 extending downwardly between the side walls 17 along the path of the corresponding short pouring gate 8 of the casting mold 6 from a position immediately after the stopping angle (I) to the stopping position (III) for contacting and closing said gate 8.

In a position adjacent to the lower edge of the blocking plate 18 on the base 1*a*, there is provided a solenoid 23 for imparting an impact to the outer side of one mold half 9*a* of the mold halves 9*a* and 9*b* opened at the stopping position (IV) so as to accelerate removal of spherical metal lumps L by pushing the exterior of the mold half 9*a* with the end of a plunger 24 of said solenoid 23. For this purpose, a slightly rough surface is provided in the cavity 7 on the side of the mold half 9*a* for avoiding adhesion of the metal lump L to the inner face of the mold half 9*b*. It is to be noted, however, that since the metal lumps L automatically drop out of the cavities 7 by the action of gravity at the angular position (IV) in most cases, the solenoid 23 is not necessarily required and may be dispensed with. The spherical metal lumps L dropped at the stopping position (IV) are fed to subsequent processes (not shown) by a chute 25 provided at the rear portion of the base 1*a*. At the stopping position (V), there is provided a detector 26 which is pivotally supported by the support frame 1 for a pivotal movement between a position shown by full lines and a position shown by a chain lines in FIG. 3, and inf any spherical metal lump L remains in the cavity-forming recess at the side of the mold half 9*a* or 9*b*, the pivotal movement of the detector 26 towards the chain line position is prevented and the detector is caused to emit a signal by suitable means (not shown), by which the entire casting operation is arranged to be interrupted. The detector 26 may be simultaneously provided with a means for applying a parting agent or a spraying device.

Figure 4:
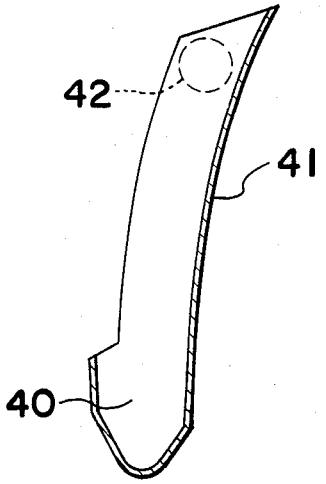
FIG. 4 is a side sectional view of a molten metal dipper member employed in the molten metal feeding device of FIG. 1, FIG. 5(*a*) is a schematic top plan view showing the construction of a casting apparatus according to a second embodiment of the present invention, FIG. 5(*b*) is a schematic front elevational view of the casting apparatus of FIG. 5(*a*), FIG. 5(*c*) is a schematic side elevational view of the casting apparatus of FIG. 5(*a*)

As shown at the left in FIG. 1, the casting apparatus is further provided with a molten metal feeding device 31 which includes support plates 32 (in FIG. 2, the support plate 32 at the right is not shown) laterally outwardly extending from the upper portions of the side walls 2, support posts 33 extending upwardly at right angles from respective end portions of the support plates 32 and opposed to each other, a rotary shaft 34 rotatably supported at its opposite ends between the support posts 33 for forward and reverse rotations, and a first piston-cylinder device 36 secured to the lower portion of one of the support posts 33, and a rod 37 of the device 36 directed upward for reciprocation in the vertical direction is provided with a rack 38 which engages a pinion 35 fixedly mounted on the rotary shaft 34. Furthermore, arm members 39 are fixedly mounted, one at each end, on the rotary shaft 34, and between the other ends of the arm members 39, dipper members 40 corresponding in number to the number of molding cavities 7 in each of the casting molds 6 and each having a handle portion 41 of a gutter shape continuing to the base portion thereof as shown in FIG. 4 are pivotally supported on said base portions by a shaft 42. Moreover, one end of another rotary shaft 43 coaxial with the rotary shaft 34 also rotatably extends through the end of one arm member 39 for being supported by the corresponding support post 33, and an endless chain 47 extends around a sprocket wheel 44 fixed to the rotary shaft 43 and a sprocket wheel 45 secured to the rotary shaft 42 over guide sprocket wheels 46, and a rack 50 formed in a rod 49 of a second piston cylinder device 48 secured to the under surface of the support post 33 is engaged with a pinion 51 fixed to the rotary shaft 43. Accordingly, as shown in FIG. 1, the arm members 39 are rotated about the rotary shaft 34 for shifting the dipper members 40 between one position immediately above the upper portion of a molten metal tank 52 shown by the solid lines and the other position immediately above the upper portion of the funnel 21 shown by the chain lines in FIG. 1.

In the above arrangement, a molten diecast alloy having a comparatively low melting point is contained through repeated replenishment in the molten metal tank 52 and is periodically replenished. The first and second cylinders 36 and 48 are driven in sychronization with the rotation and stopping of the intermittent rotary shaft 3. Accordingly, when the rotary shaft 3 is rotated from its stopped state, the arm members 39 for the molten metal feeding device 31 are brought to the position shown by the solid lines in FIG. 1 by the rising movement of the rod 37 of the first device 36 and thus, the dipper members 40 are directed into the interior of the molten metal tank 52 approximately vertically. Subsequently, upon descent of the rod 37, the rack 38 engaged with the pinion 35 causes the rotary shaft 34 to rotate clockwise, and immediately after the particular mold halves 9*a* and 9*b* in the closed state have stopped at the stopping position (I) following the stopping of the intermittent rotary shaft 3, the arm members 39 are pivotally moved to the position shown by the chain lines in FIG. 1. Although the endless chain 47 is not driven during said pivotal movement of the arm members 39, the sprocket wheel 45 is rotated counterclockwise by the chain 47 when it is in the stationary state, thereby causing the dipper members 40 to rotate together with the shaft 42, and thus, the dipper members 40 are moved to the left side of the molten metal pouring funnel 21 while remaining in the approximately vertically directed state similar to that when they are immersed in the molten metal tank 52 at the position shown by the solid lines in FIG. 1. Immediately before or after the above movement of the dipper members 40, the rod 49 of the second device 48 is lowered for rotating the pinion 51 clockwise by the rack 50. Therefore, the dipper members 40 are swung into an inclined state as shown by the heavy chain lines in FIG. 1 where the end of each of the handle portions 41 thereof is aligned with the upper opening of the funnel 21 for pouring the predetermined amount of the dipped molten metal into the funnel 21 through the handle portion 41. Then the arm members 39 are returned to the position shown by the solid lines by the ascent of the rod 37 as the dipper members 40 are returned to the original position of the original angle descent of the rod 49.

On the other hand, the predetermined amount of molten metal supplied into the funnel 21 in the manner as described above is filled through the short pouring gates 8 into the cavities 7 and also into said pouring gates 8. In the above case, since the casting molds 6 are being cooled by the cooling water passing through the passages 16*a* and 16*b*, the portion of the molten metal contacting the wall surfaces of the cavities 7 is quickly cooled to form chilled layers at the surface thereof while the casting molds 6 are successively moved to the angular positions (II) and (III), during which period, the short pouring gates 8 are closed by the arcuate rear wall 22 of the corresponding blocking plates 18, so that the molten metal within the pouring gates 8 is also cooled by the contact thereof with said rear walls 22. Accordingly, the molten metal not yet solidified at the central portion adheres to the inner face of the surface layer to form the spherical solidified metal lump L, and a void F (shrinkage void) formed in the interior due to shrinkage action in the above case produces in the interior of the metal lump L a space at a vacuum and forming almost no concave or convex portions on the surface of such a spherical metal lump L. Meanwhile, at the initial stage of movement of the casting molds 6 from the stopping position (III) to the stopping position (IV), the short pouring gates 8 are disengaged from the arcuate walls 22 of the blocking plates 18, and at the stopping position (IV), the mold halves 9*a* and 9*b* are opened by the small diameter portions 15 of the cam plates 13 and the weight of the spherical metal lumps L for causing the metal lumps L to drop onto the chute 25 for rolling therealong. The mold halves 9*a* and 9*b* are closed at the angular position (VI).

The spherical metal lumps L to be cast in a small size, for example, 80 to 120 mm in diameter, are intended to be free from recesses due to shrinkage at the surfaces for facilitated rolling during supplying thereof into subsequent processes and to prevent explosions of air contained in the shrinkage voids formed therein by an abrupt rising of temperatures. It is to be noted here that, although the center of gravity of the metal lump L deviates to a certain extent from the center of the sphere in most cases since the voids F are not necessarily formed at the central portion of the lump L, such deviations, or sprues, etc. produced by the short pouring gates may be completely neglected for achieving the object of the present invention.

As is clear from the above description, according to the invention, each of the plurality of casting molds 6 having the spherical cavities 7 formed therein and short pouring gates 8 extending outwardly from said cavities 7 is split in the radial direction to form a pair of mold halves 9*a* and 9*b* which can selectively be opened and closed, with the base portions of said mold halves being pivotally connected to the intermittent rotary member including the disc members 4 fixedly mounted on the rotary shaft 3 so as to radially outwardly extend from the path of rotation, while the mold halves 9*a* and 9*b* are arranged to be closed at the top position or the position prior to said top position and to be opened at the lower position in the rotational path by the open and close control member such as the fixed cam plates 13. The short pouring gates 8 of the closed mold halves 9*a* and 9*b* are successively stopped at the lower opening O of the molten metal pouring funnel 21 provided at said top position for filling the cavities 7 and short pouring gates 8 with the predetermined amount of molten metal poured into the funnel 21, and without leaving the molten metal in the cavities 7 to stand until it is cooled for hardening, the mold halves (i.e. the cavities 7) are rotated to successively bring the short pouring gates 8 to the sidewise positions so that the inner ends of the pouring gates 8 leading to the cavities 7 are closed by the chilled layers formed at the outer surfaces of the spherical metal lumps and unhardened metal in the inner portions thereof until such a time that most of the molten metal filled in the cavities 7 has been solidified, and subsequently, when the mold halves are brought to the position under the rotary member, they are opened to eject the spherical metal lumps by gravity. In the above arrangement, since external air is not drawn into the interior of the metal lumps through the short pouring gates 8 or through the peripheral portions of the cavities 7, the contraction in volume of the metal lumps in the course of solidification of the molten metal produces voids almost in the vacuum state in the interior of the metal lumps. Therefore, hardly any concave or convex portions ae formed in the surfaces of the metal lumps generally contacting the cavities 7, and thus, the metal lumps are cast into spherical shapes having superior rolling characteristics. Moreover, by providing a large number of cavities 7 and pouring gates 8 in the casting molds 6, large numbers of spherical metal lumps can be cast with high efficiency.

Furthermore, since the casting apparatus of the present invention is further provided with the molten metal feeding device which is arranged to rotate the arm members 39 in association with the movement of the intermittent rotary member, the continuous casting of the spherical metal lumps can be carried out with high efficiency through the inclined molten metal pouring positioning of the dipper members 40.

The casting apparatus CA according to the first embodiment of the present invention as described in the foregoing, although very efficient in its operation, still has some disadvantages as follows.

If the casting apparatus CA of FIGS. 1 to 3 is arranged to pour the molten metal into the casting molds at the stopping position (I) for intermittent rotation thereof, for example, every 15 seconds for production efficiency, a time period of only 30 seconds passes during two steps of the intermittent rotation from the stopping position (I) to the starting of opening of the split molds, and thus, shrink marks tend to be formed in the spherical metal lumps in the course of cooling, with a possibility of hindering the smooth rolling of the spherical metal lumps.

Accordingly, in a second embodiment of the present invention to be described hereinbelow with reference to FIGS. 5 to 11(*c*), it is intended to provide a further improved casting apparatus CB for casting spherical metal lumps in which the mold halves are mounted at five positions provided by radially dividing the rotational path of the intermittent rotary member into five equal parts. Thus, even when the casting molds are subjected to the intermittent rotation, for example, at every 12 seconds, a time period as long as 48 seconds may pass during four steps of an intermittent rotation through an angle equivalent to two parts of said five equally divided parts, whereby spherical metal lumps free from formation of shrink marks can be produced to high efficiency and improvement of distribution of the molten metal into the casting molds by the large degree of rotation resulting from the intermittent rotation through the angle equivalent to the two parts of said five divided parts of the rotational path.

More specifically, according to the second embodiment of the present invention there is provided an improved casting apparatus for casting spherical metal lumps which comprises a support frame, an intermittent rotary member rotatably supported on said support frame, a plurality of casting molds extending to radially outwardly from said intermittent rotary member, each of said casting molds including a pair of mold halves which are split in a radial direction, spherical cavities formed in said metal mold and corresponding short pouring gates extending outwardly from said spherical cavities, with a base portion of each of said pair of the mold halves being pivotally supported on said intermittent rotary member, means for successively closing said pair of the mold halves at a top position in a rotational path of said mold halves for pouring the molten metal into said spherical cavities through said short pouring gates and to open said pair of the mold halves at a lower position in said rotational path for dropping and discharging the spherical metal lumps by rotation of said intermediate rotary member, and a molten metal pouring funnel fixedly provided at said top position of the rotational path and arranged to be successively communicated with the corresponding one of said short pouring gates for pouring the molten metal into said cavities, said mold halves each being mounted at least at one of positions provided by radially dividing said rotational path of said intermittent rotary member into five equal parts, with means for intermittently rotating said intermittent rotary member through an angle equivalent to two parts of said five equally divided parts being provided for subjecting the respective split molds at a stopping position (I)′ at the top position to the intermittent rotation through an angle equivalent to the two parts of said five equally divided parts in the order of stopping positions (II)′, (III)′, (IV)′, (V)′ and (I)′ with the stopping positions provided around the periphery of said rotary member in the order of (I)′, (IV)′, (II)′, (V)′ and (III)′ in the rotational direction of the intermittent rotary member, whereby the respective split molds are closed at said stopping position (I)′ for pouring the molten metal into the spherical cavities through said short pouring gates, and opened at said stopping position (V)′ for discharging the spherical metal lumps, with a split mold opening device capable of forcibly opening the corresponding one of the split molds during stopping of the intermittent rotation through being provided at the stopping position (I)′ by opening of a mold half retaining member which normally retains the respective mold halves in a closed state.

Figure 5:
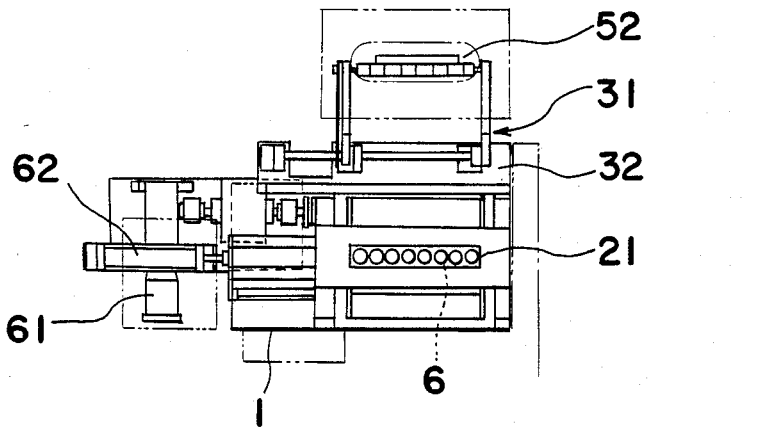
Figure 5B:
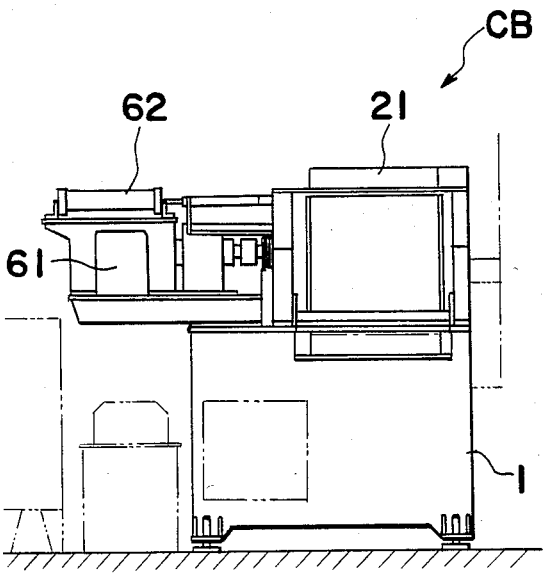
Figure 5C:
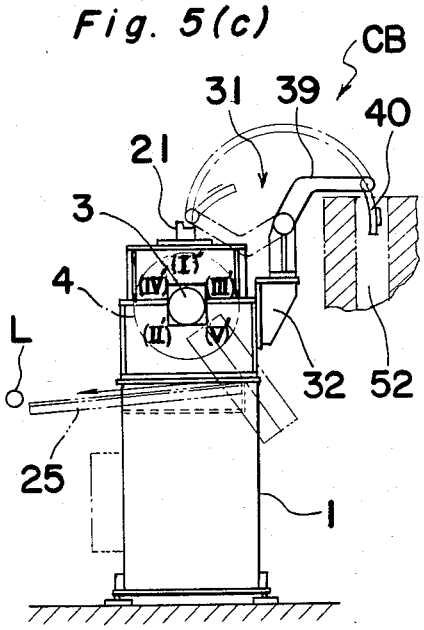

Referring now to FIGS. 5(*a*) to 5(*c*), the casting apparatus CB according to the second embodiment of the present invention generally includes, in a similar manner as in the casting apparatus CA of FIGS. 1 to 4, the support frame 1, the intermittent rotary shaft 3 rotatably supported by the support frame 1, the rotary discs 4 fixedly mounted on the rotary shaft 3, casting molds 6 respectively mounted on the rotary discs 4 in positions spaced around the rotary discs 4 at five equal angles, the molten metal pouring funnel 21 provided at the top position, and the molten metal feeding device 31 mounted on the support frame 1 by a support piece 32 for dipping up the predetermined amount of the molten metal from the molten metal tank 52 provided at one side of the base 1*a* of the support frame 1 and for pouring the molten metal thus dipped up into the funnel 21 by inclination of the dipper members 40.

At the upper part of the support frame 1, there are provided a motor 61 for driving a geneva gear 63 (FIG. 8) which intermittently rotates the intermittent rotary shaft 3 and a third piston cylinder device 62 which selectively extends or withdraws rods 80 and 81 for engaging or disengaging auxiliary mold clamps 82 (FIG. 9) which retain the respective casting molds in the closed state, while the chute 25 is provided at the lower part of the support frame 1 for discharging the spherical metal lumps L dropped from the mold halves 9*a* and 9*b* at the stopping position (V)′ out of the apparatus CB.

Since the construction and functions of the molten metal feeding device 31 are generally similar to those in the arrangement of FIGS. 1 to 4, a detailed description thereof is abbreviated here for brevity.

Figure 6:
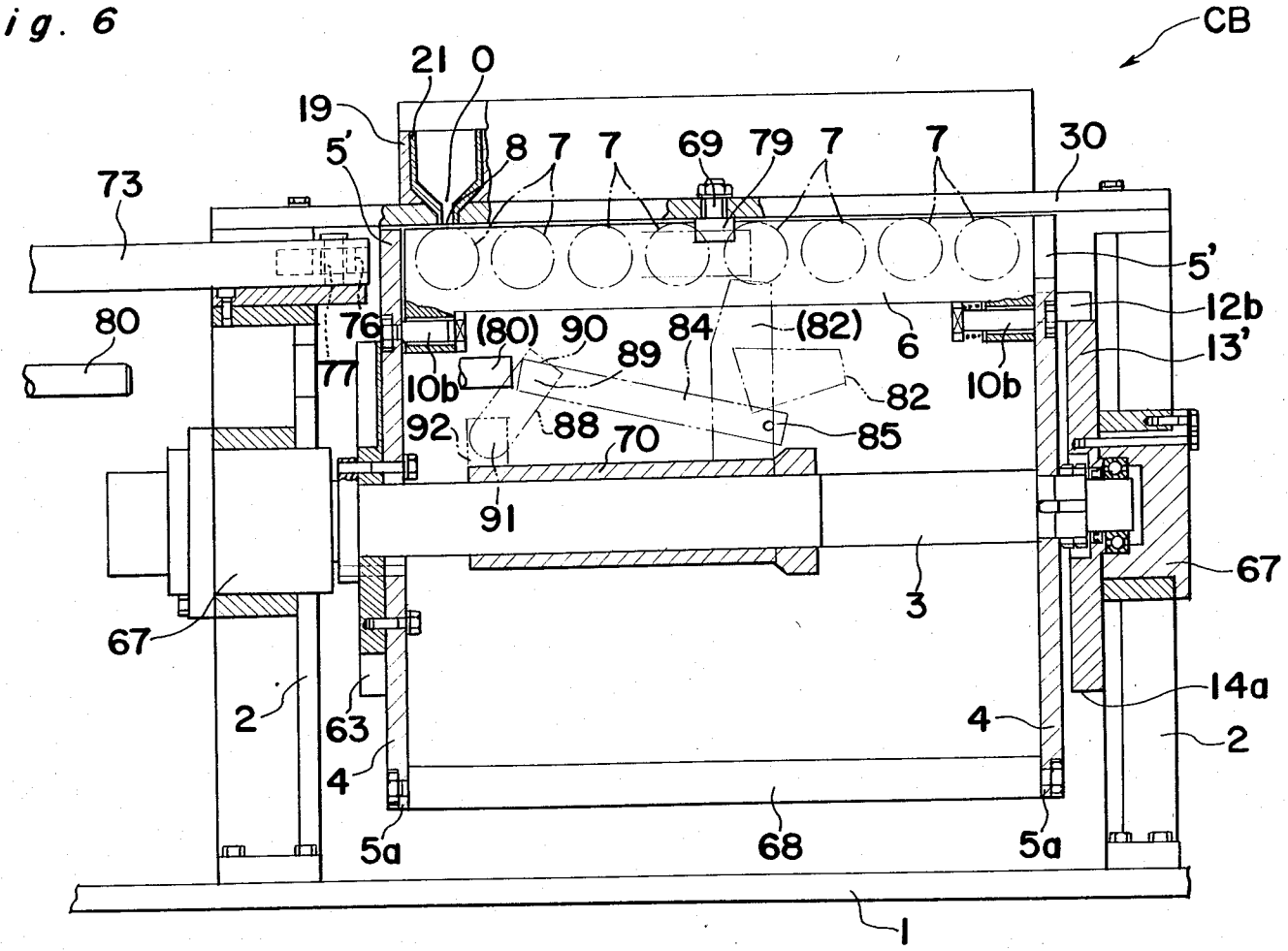
FIG. 6 is a front sectional view, on an enlarged scale, of the casting apparatus of FIG. 5(*a*)
Figure 7:
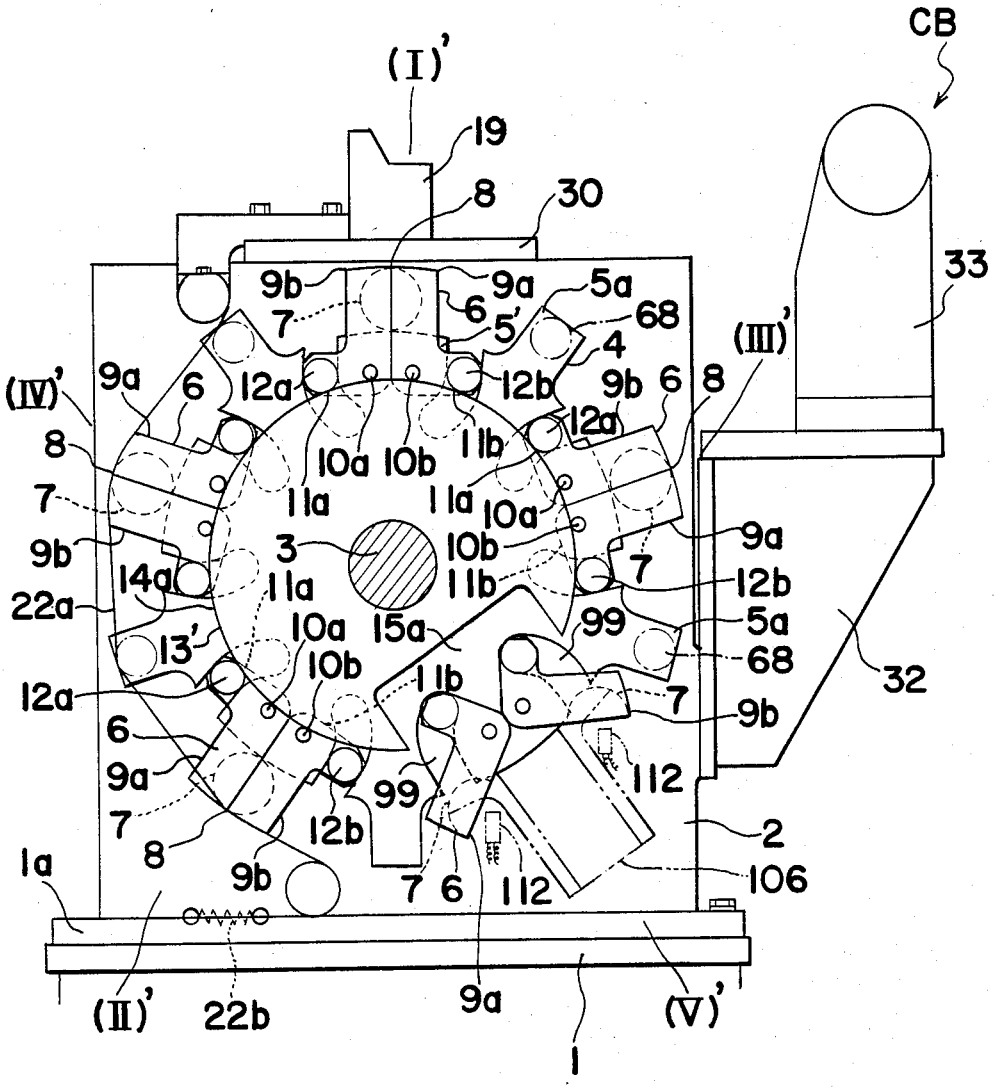
FIG. 7 is a side elevational view of the casting apparatus of FIG. 6.

The intermittent rotary shaft 3 horizontally extending through the opposite side walls 2 of the support frame 1 and rotatably supported thereby in bearings 67 (FIG. 6) is arranged to be intermittently rotated through an angle equivalent to two of the five equally divided parts of the rotational path, i.e. through 144° and then stopped, with a cam plate 13′ being secured to the inner surface of the side wall 2 at the right side in FIG. 6 in a coaxial relation with the rotary shaft 3, and the rotary discs 4 are fixedly mounted on the rotary shaft 3, one of which rotary discs 4 is positioned slightly inwardly with respect to the cam plate 13′. Each of the rotary discs 4 has pivotal support portions 5′ spaced at an angular interval of 72° for division of its circumference into the five equal parts. As shown in FIG. 7, between the portions 5′ of the opposed rotary discs 4, there are provided the casting molds 6 each arranged to further extend radially outwardly from said portions 5′ and having formed therein a plurality of (eight in this embodiment) spherical cavities 7 spaced at regular intervals in the direction parallel to the axis of the intermittent rotary shaft 3 and also with corresponding pouring gates 8 outwardly extending from respective spherical cavities 7. Each of the casting molds 6 comprises the pair of mold halves 9*a* and 9*b* which are divided in the radial direction, and having therein said spherical cavities 7 and pouring gates 8, while base portions of each pair of said split molds are pivotally supported by shafts 10*a* and 10*b* provided between said portions 5′. The mold halves 9*a* and 9*b* further include arm portions 11*a* and 11*b* laterally symmetrically extending from the base portions thereof and having contact rollers 12*a* and 12*b* rotatably provided at their distal ends for contact with the peripheral surface of the cam plate 13′. The cam plate 13′ has the large diameter portions 14*a* and the small diameter portions or recess 15*a* for control so as to close the mold halves 9*a* and 9*b* at respective stopping positions (I)′, (II)′, (III)′ and (IV)′ and to open said mold halves at angles of 35° to 45° at the stopping position (V)′ of the casting molds 6. For cooling purposes, the mold halves 9*a* and 9*b* are respectively provided with cooling water passages similar to be passages 16*a* and 16*b* as in the first embodiment, although they are not shown here.

As shown in FIG. 1, the stopping position (I)′ is located at a top position in the rotational path of the casting molds 6, and in said top position, there is provided the funnel support member 19 secured onto an upper plate 30 which is held between the side walls 2. The heat resistant molten metal pouring funnel 21 is fitted into the support member 19, and the short pouring gates 8 of the spherical cavities 7 for the casting molds 6 which are successively rotated to the stopping position (I)′ and stopped thereat are brought into alignment with a lower opening O of the funnel 21 (FIG. 6). Between the upper plate 30 and the bottom portion 1*a* of the support frame 1, there is provided a concave arcuate belt member 22*a* suitably stretched by a tension spring 22*b* and extending downwardly along the path of the short pouring gates 8 of the casting molds 6 from the position immediately after the stopping position (I)′ down to the stopping position (II)′ for contacting and closing said gates 8.

Between the respective pivotal support portions 5′ of the rotary discs 4, there are further formed projections 5*a* radially outwardly extending from the rotary discs 4, between which, shaft members 68 are provided to hold the rotary discs 4 in a confronting state.

Figure 8:
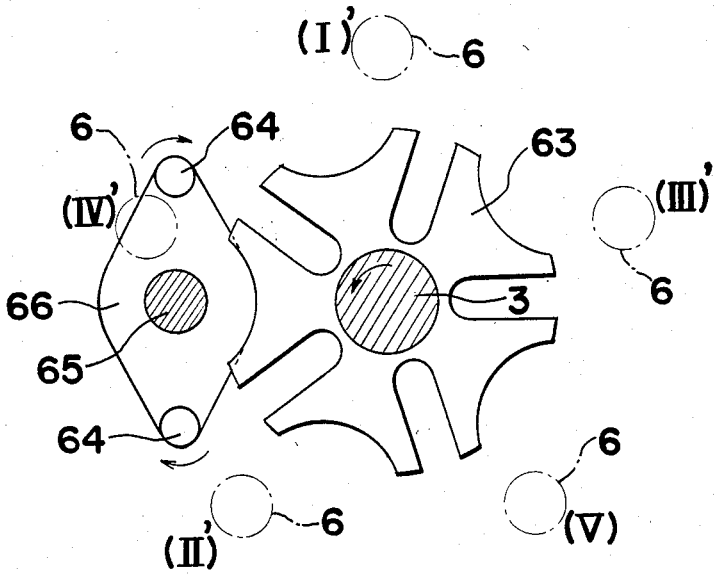
FIG. 8 is a top plan view, on a still further enlarged scale, showing the construction of a geneva gear arrangement employed in the casting apparatus of FIG. 5(*a*)

As shown in FIGS. 6 and 8, the geneva gear 63 for the five equal angles and which subjects the rotary shaft 3 to the intermittent rotation is secured to the rotary disc 4 at the left side in FIG. 6, and is adapted to be intermittently rotated through an angle equivalent to the two parts of the five equally divided of the rotational path by a pin wheel 66 having two pins 64 extending upwardly from its opposite ends at angular positions of 180°, the pin wheel being fixedly mounted on a shaft 65 rotated by the motor 61, as the pin wheel 66 makes one rotation. Therefore, the casting mold 6 located at the stopping position (I)′ is intermittently rotated through the angle equivalent to the two parts of the five equally divided parts described earlier through large angles in the order of the stopping positions (II)′→(III)′→(IV)′→(V)′→(I)′, with a consequent improvement in the distribution of the molten metal within the casting mold 6.

Figure 9:
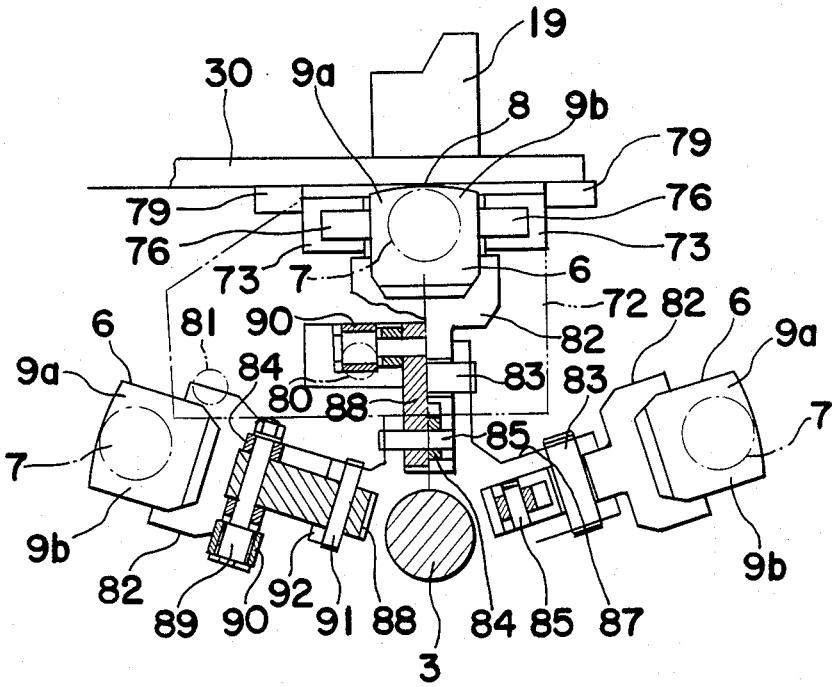
FIG. 9 is a fragmentary side elevational view, partly in section, showing an auxiliary mold clamp arrangement employed in the casting apparatus of FIG. 5(*a*), FIG. 10(*a*) is a fragmentary top plan view showing the relation between a casting mold and bars associated therewith and employed in the casting apparatus of FIG. 5(*a*), FIG. 10(*b*) is a side elevational view of the arrangement of FIG. 10(*a*) showing the relation between the casting mold and auxiliary mold clamp, FIG. 11(*a*) is a fragmentary side elevational view showing on an enlarged scale, a mold opening device employed in the casting apparatus of FIG. 5(*a*), FIG. 11(*b*) is a fragmentary side elevational view showing the relation between an extruding member, contact rollers and a cam member employed in the arrangement of FIG. 5(*a*), FIG. 11(*c*) is a sectional view of the mold opening device of FIG. 11(*a*), FIG. 12(*a*) is a side sectional view of a modified molten metal feeding device which may be employed in the casting apparatus of FIG. 5(*a*), and FIG. 12(*b*) is a fragmentary sectional view of a molten metal feeding pipe employed in the molten metal feeding device of FIG. 12(*a*).
Figure 10A:
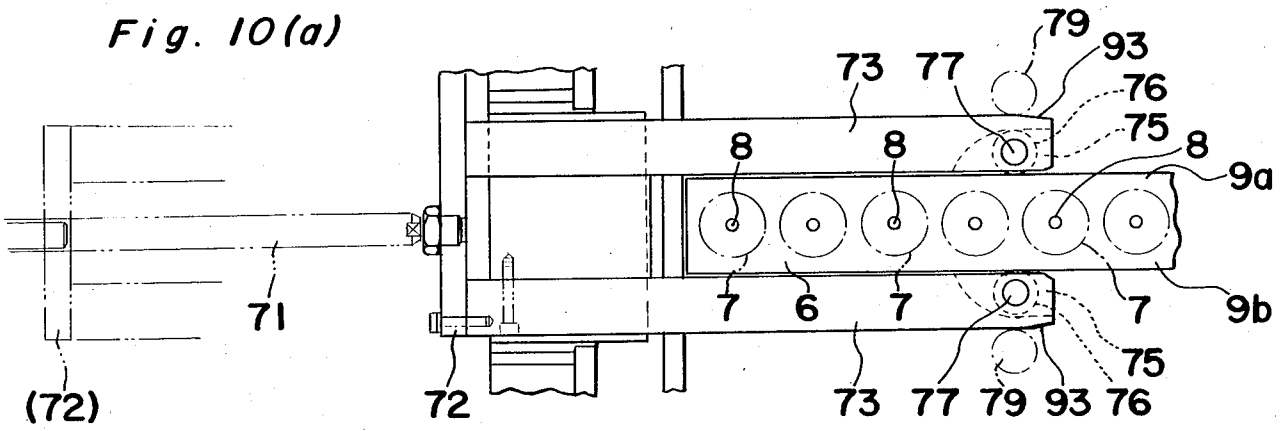
Figure 10B:
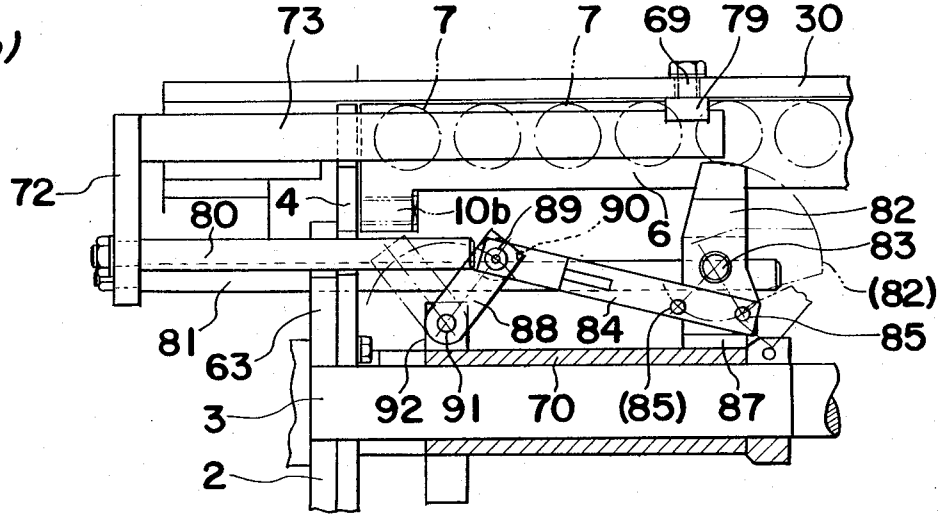

Referring to FIGS. 9, and 10(*a*) and 10(*b*), at the stopping position (I)′, a plate member 72 is fixed at right angles to a piston rod 71 of the third piston cylinder device 62 secured to the support frame 1, while two bars 73 are provided which extend laterally from said plate member 72 in a parallel relation to hold the casting mold 6 therebetween. At the distal end of each of the bars 73, a groove 75 is formed, in which a roller 76 is rotatably supported by a pin 77. On the under surface of an upper plate 30 on the support frame 1, there are rotatably provided two rollers 79 on corresponding shafts 69 so as to hold said bars 73 therebetween. The plate members 72 has two rods 80 and 81 laterally extending therefrom, with the rod 80 acting to engage an auxiliary mold clamp 82 when the casting mold 6 is at the stopping position (I)′, while the rod 81 functions to disengage the auxiliary mold clamp 82 at the stopping position (IV)′. At the other end of the generally U-shaped mold clamp 82 which is pivotable about a shaft 83, a lever 84 is pivotally connected to clamp 82 through a shaft 85, and the mold clamp 82 is pivotally coupled through the shaft 83 to a bracket 87 for a bushing 70 fitted on the intermittent rotary shaft 3. The other end of the lever 84 is rotatably connected to another lever 88 through a shaft 89. A roller 90 is rotatably mounted at one end of the shaft 89 so as to contact the distal end of the rod 80 described earlier, while the other end of the lever 88 is rotatably connected to a bracket 92 on a bushing 70 through a shaft 91.

Accordingly, upon advancing of the piston rod 71 at the stopping position (I)′, the casting mold 6 is held between the rollers 76 provided at the ends of the bars 73, and when the piston rod 71 further advances, the bars 73 are held between the rollers 79 so as to be clamped thereby for tightly clamping the casting mold 6. In the above case, tapered portions 93 provided at the distal ends of the bars 73 are effective for facilitation of entry of the bars 73 between the rollers 79. The rod 80 on the plate member 72 rotates the lever 88 clockwise in FIG. 10*b* by the contact of the distal end of said rod 80 with the roller 90 on the lever 88 as the plate member 72 advances. Following the above operation, the lever 84 raises the auxiliary mold clamp 82 from the lowered position counterclockwise in FIG. 10*b* to the upright position, and thus, the casting mold 6 is held in the mold clamp 82.

Subsequently, upon advancing of the plate member 72, the distal end of the rod 81 contacts one side of the auxiliary mold clamp 82 arriving at the stopping position (IV)′ so as to lower the mold clamp 82 from the upright position to the lowered position for clamping the casting mold.

In other words, by the advancing of the plate member 72, the clamping of the mold parts by the bar 73 (main mold clamping) and by the auxiliary mold clamp 82 are effected at the stopping position (I)′, and simultaneously, at the stopping angle (IV)′, the mold clamping by the mold clamp 82 is released.

Upon completion of the above procedures, the molten metal is poured into the casting mold 6 through the short pouring gates 8 by the molten metal feeding device 31. When the molten metal pouring is completed, the piston rod 71 is retracted, and through retraction of the plate member 72, the bars 73 are disengaged from the rollers 79, and further completely separated from the casting mold 6.

In the above case, the auxiliary mold clamp 82 at the stopping position (I)′ is at the upright position, and intermittently rotated through the angle equivalent to the two parts of the five equal parts described earlier in the order of the stopping positions (I)′→(II)′→(III)′→(IV)′→(V)′ together with the casting mold 6, while clamping said casting mold 6, and the mold clamping is released at the stopping position (IV)′ as described earlier.

The contact rollers 12*a* and 12*b* rotatably provided on the arm portions 11*a* and 11*b* of the casting mold 6 are arranged to roll over the circumferential portion of the cam plate 13′, and a recess 15*a* is provided therein at the position corresponding to the stopping position (V)′ of the cam plate 13′. In the rotary discs 4, the shafts 10*a* and 10*b* for the casting mold 6 are rotatably mounted for enabling the mold halves 9*a* and 9*b* to be opened by rotation about said shafts 10*a* and 10*b*.

Figure 11A:
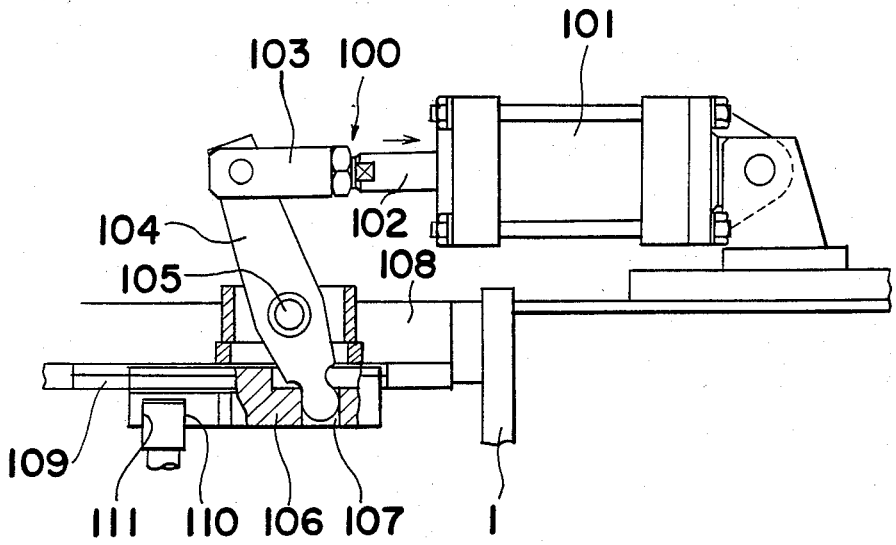
Figure 11B:
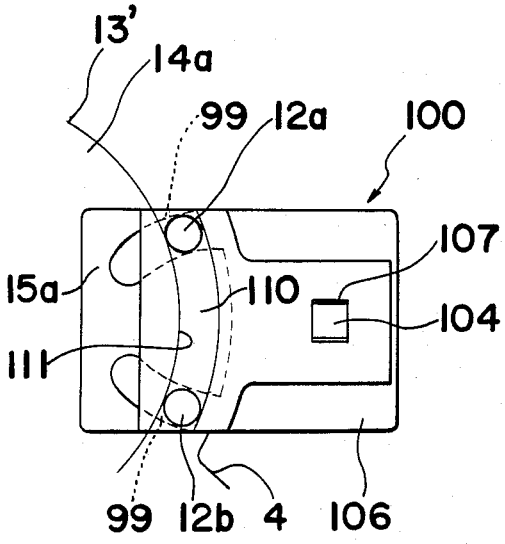
Figure 11C:
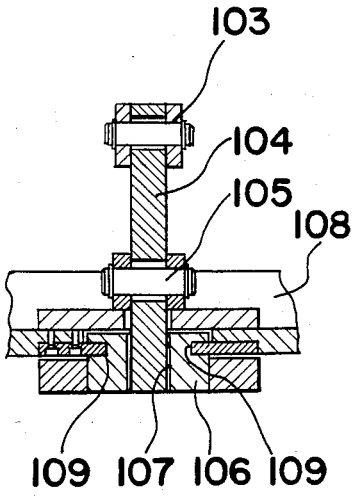

In the rotary disc 4 at the side toward the cam plate 13′, at positions where the mold halves 9*a* and 9*b* are pivotally connected by the shafts 10*a* and 10*b*, a pair of opposed arcuate grooves 99 are formed at five places corresponding to the stopping angles (I)′ to (V)′. At the stopping positions (I)′, (II)′, (III)′ and (IV)′, the contact rollers 12*a* and 12*b* are positioned at the end portions of the grooves 99 (i.e. on the periphery of the cam plate 13′) (FIG. 11(*b*)), and at the stopping position (V)′, they are positioned at the bottom portions of the grooves 99 during the opening of the molds. At the position of the stopping angle (V)′, a mold opening device 100 is mounted on the support frame 1 as shown in FIGS. 11(*a*), 11(*b*) and 11(*c*). The mold opening device 100 includes a lever 103 secured to the distal end of a piston rod 102 of a fourth piston cylinder device 101, with another lever 104 being pivotally connected to said lever 103. The lever 104 is rotatable about a shaft 105, and the distal end of the lever 104 is inserted into an opening 107 formed in a roller moving member 106, which is slidable in a sliding groove formed in a frame 108 of the support frame 1.

The roller moving member 106 has an arcuate groove 110 with the inner side 111 of said groove 110 conforming with the outer periphery of the cam plate 13′. Accordingly, upon intermittent rotation of the casting mold 6 from the stopping position (II)′ to position (III)′, the contact rollers 12*a* and 12*b* can roll along the inner side of the arcuate groove 110 without dropping into the recess 15*a* at the stopping position (V)′, i.e. into the curved grooves 99.

It is to be noted here that the recess 15*a* has a width sufficient to allow the entry of the roller moving member 106, and that the rotary disc 4 at the other side is not provided with the curved grooves 99. Therefore, at the stopping position (IV)′, although the auxiliary mold clamp 82 is disengaged, the mold halves 9*a* and 9*b* are not opened, since the contact rollers 12*a* and 12*b* are located on the peripheral surface of the cam plate 13.

At the stopping position (V)′, when the fourth piston cylinder device 101 is actuated, with consequent retraction of the piston rod 102 and clockwise rotation of the lever 104, the roller moving member 106 is advanced by rotation of the lever 104 so as to move the contact rollers 12*a* and 12*b* located in the arcuate groove 110 toward the bottom portions of the curved grooves 99, and consequently, the mold halves 9*a* and 9*b* are by being pivoted about the shafts 10*a* and 10*b* for discharging the spherical metal lumps L therefrom.

The piston rod 102 is arranged to reciprocate approximately three times by the action of a timer (not shown), and at the third mold opening, after detecting that all of the spherical metal lumps L (eight pieces in this embodiment) have been dropped from the mold halves 9*a* and 9*b*, for example, by a pair of phototubes 112 provided adjacent to said split molds (FIG. 7), the roller moving member 106 is returned to the original position. Meanwhile, if any spherical metal lumps L are detected remaining in the casting molds 6, the apparatus is shut down to remove such metal lumps from the casting molds 6, i.e. the mold halves 9*a* and 9*b*.

Upon the retunr of the roller moving member 106 to the original position, the mold halves 9*a* and 9*b* are closed thereby, and again moved toward the initial stoppong position (I)′.

By the above arrangement, when the casting mold 6 subjected to the intermittent rotation through the angle equivalent to the two parts of the five equally divided parts of the path of rotation from the stopping position (V)′ is stopped at the stopping position (I)′, the casting mold 6 is clamped (main mold clamping) by the two bars 73 as the piston rod 71 of the third piston cylinder device 62 advances, while the auxiliary mold clamp 82 is turned upright by the rod 80 of the plate 72 through the levers 88 and 84 for the auxiliary mold clamping of the casting mold 6.

Upon completion of the above mold clamping, the predetermined amount of the molten metal is fed into the molten metal pouring funnel 21 by the molten metal feeding device 31 described earlier, and thus, the molten metal is poured into the spherical cavities 7 through the short pouring gates 8 so as to fill said cavities 7 and pouring gates 8.

When the pouring of the molten metal has been completed, the piston rod 71 is retracted, and the bars 73 are spaced from the casting mold 6, and the rod 80 is also completely spaced therefrom, and the bar 88 is rotated rightward.

Subsequently, by the driving of the motor 61, the rotary shaft 3 is intermittently rotated through the angle equivalent to the two parts of the five equally divded parts by the geneva gear 63.

In the above case, since the casting molds 6, i.e. mold halves 9*a* and 9*b* are cooled by the cooling water passing through the cooling water passages thereof, the portion of the molten metal contacting the inner surfaces of the spherical cavities 7 is rapidly cooled to form a chilled layer on the surface of the metal lump L as described earlier with reference to the first embodiment of FIGS. 1 to 4, while, during the intermittent rotation of the casting molds 6 from the stopping positions (I)′ to (II)′ through the stopping position (IV)′, the short pouring gates 8 are closed by the arcuate belt 22*a*, and simultaneously, the molten metal within the short pouring gates 8 is cooled by the contact thereof with the belt 22*a*. The unhardened molten metal at the central portion adheres to the inner faces of the surface layers of the hardening molten metal during the intermittent rotation of the casting mold 6 to form the spherical lumps L, and the voids (shrinkage voids) formed inside due to the shrinking action in the above case cause the inner space to be at a vacuum state, forming almost no concave or convex portions are formed on the surface of the metal lumps L.

While the particular casting mold 6 is stopping at the stopping position (II)′ and at each of the stopping positions described later, the subseqeunt casting molds 6 are successively stopped at the stopping position (I)′ for carrying out the mold clamping and molten metal pouring in the procedures as described earlier.

Subsequently, the particular casting mold 6 is intermittently rotated from the stopping position (II)′ to the stopping position (III)′ via the stopping position (V)′ by the continuous intermittent rotation of the rotary shaft 3 through the angle equivalent to the two parts of the five equally divided parts, but the short pouring gates 8 are separated from the arcuate belt 22*a* before the casting mold 6 reaches the stopping position (V)′, and at said stopping angle (V)′, the contact rollers 12*a* and 12*b* of the casting mold 6 roll past the arcuate groove 110 of the extruding member 106 without dropping into the curved grooves 99, and therefore, the casting mold 6 is not opened.

Furthermore, the particular casting mold 6 is subsequently subjected to the intermittent rotation from the stopping position (III)′ to position (IV)′, and from position (IV)′ to position (V)′ through the angles equivalent to the two parts of the five equally divided parts mentioned earlier, and upon stopping of said casting mold 6 at the stopping position (V)′, owing to the advancing of the plate 72 of the piston rod 71 of the third piston cylinder device 62, the mold clamping of the auxiliary mold clamp 82 for the casting mold 6 at the stopping position (I)′ is effected by the rod 80, while simultaneously, the mold clamping is disengaged by the rightward turning of the auxiliary mold clamp 82 by the rod 81.

Thereafter, the fourth piston cylinder device 101 is actuated to advance the roller moving member 106 by rotation of the lever 104, and thus, the contact rollers 12*a* and 12*b* located in the arcuate groove 110 are moved in the bottom portions of the curved grooves 99 of the rotary disc 4 for opening the mold halves 9*a* and 9*b* about the shafts 10*a* and 10*b*. By the opening of the mold havles 9*a* and 9*b*, the cast spherical metal lumps L fall and are discharged from the apparuats by rolling down the chute 25.

Upon returning of the roller moving member 106 to the original position by the functioning of the fourth piston cylinder device 101, the mold halves 9*a* and 9*b* are closed by the arcuate groove 110 through the contact rollers 12*a* and 12*b*, and they are moved and stopped again at the stopping position (I)′ by the subsequent intermittent rotation through the angle equivalent to the two parts of the five equally divided parts for the mold clamping and molten metal pouring.

As described above, since the molten metal is subjected to the intermittent rotation through the stopping positions (I)′→(II)′→(III)′→(IV)′→(V)′ from the pouring of the molten metal into the casting mold 6 at the stopping position (I)′ and discharging of the spherical metal lumps at the stopping position (V)′, i.e. since it is retained in the casting mold 6 for a period equivalent to as long as about one and a half rotations of the rotary disc 4, the spherical metal lumps L are substantially perfectly solidified to their central portions, and thus, the occurrence of shrinkage as in the case where the metal lumps are discharged in the unsolidified state can be advantageously prevented.

Although the molten metal feeding device 31 described as employed in the foregoing embodiments is a dipping-up type, this may be replaced by a pump-type molten metal feeding device 113 of as described hereinbelow.

Figure 12:
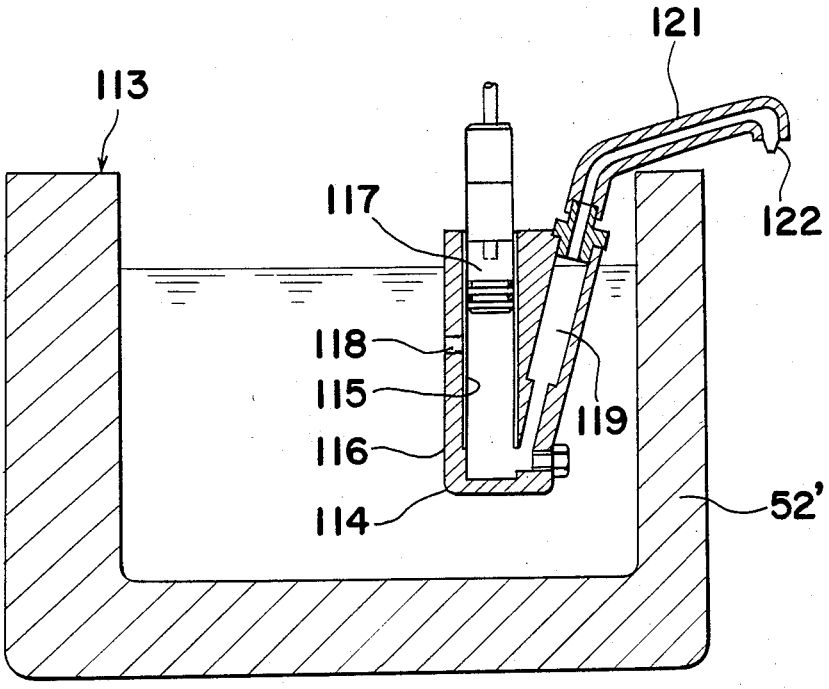
Figure 12:
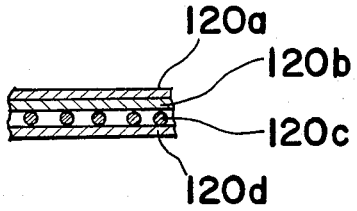

Referring to FIGS. 12(*a*), and 12(*b*), the molten metal feeding device 113 includes a pump body 114 of a cast material immersed in the metal melting tank 52′, a sleeve 115 of chrome molybdenum material fitted into the pump body 114 to form a cylinder 116, a piston 117 slidably provided in the cylinder 116 for drawing in a predetermined amount of the molten metal through a supply port 118, a molten metal sump 119 communicated with the bottom portion of the cylinder 116, a molten metal feeding pipe 121 constituted by a stainless steel pipe 120*a*, an insulation material 120*b* of silica glass, etc., a heater wire 120*c* of nichrome wire or the like, a heat insulation 120*d* of refractory material (FIG. 12(*b*)), and connected to the molten metal sump 119, and a nozzle 122 of stainless steel mounted at the distal end of the pipe 121 directed in to the molten metal pouring funnel 21.

Accordingly, the molten metal drawn into the cylinder 116 in a predetermined amount through the supply port 118 as the piston 117 returns in its reciprocation, is fed into the funnel 21 from the nozzle 122 through the sump 119 and pipe 121 upon the advancing of the piston 117. In the above case, although the molten metal in the sump 119 is supplied into the cylinder 116 upon returning movement of the piston 117, if the sump 119 is sufficiently large in volume, there is no such disadvantage that air entering through the nozzle 122 is introduced into the cylinder 116.

Moreover, since the molten metal feeding pipe 121 is provided with an inclination so as to be directed upward, the molten metal remaining in the pipe 121 during the molten metal pouring is directed downward toward the sump 119 for being returned, and only a small amount of the molten metal staying in the nozzle 121 drips from said nozzle 121, with an efficient dripping off of the molten metal from said nozzle 121.

As is clear from the foregoing description, according to the embodiment of FIGS. 5 to 12(*b*) the casting molds including the mold halves are mounted at least at one of the positions provided by equally dividing the rotational path of the intermittent rotary member into the five equal parts, and the molds at the stopping position (I)′ in the upper position are respectively intermittently rotated through an angle equivalent to the two parts of the five equally divided parts in the order of the stopping positions (II)′, (III)′, (IV)′, (V)′ and (I)′, and the molten metal is poured into the respective split molds closed at the stopping position (I)′, while each of the molds is forcibly opened by the mold opening device at the stopping position (V)′ for discharging the spherical metal lumps to be discharged.

Therefore, according to the present invention, after the molten metal has been poured into the respective molds, it is not left to stand until solidification by cooling, but the casting mold is initially rotated to a large degree from the stopping angles (I)′ of the position (II)′ for a better distribution of the molten metal within the spherical cavities, while simultaneously, the inner end openings of the pouring gates communicated with the spherical cavities are blocked by the chilled layers formed at the outer surfaces of the metal lumps and the unsolidified metal inside said metal lumps. The blocking as described above is continued until most of the molten metal in the spherical cavities is solidified for retaining the state from the stopping position (II)′ to the stopping positions (III)′, (IV)′ and (V)′, and at the stopping position (V)′, the metal lumps L completely solidified are discharged.

Although in the arrangement of the embodiment of FIGS. 1 to 4, the operation from the pouring of molten metal to the discharge of the spherical metal lumps are effected through the two intermittent rotations through the stopping positions (I) to (III), with a long cycle required for the intermittent rotation to achieve a sufficient cooling period and a consequent reduction in productivity, the arrangement of the embodiment of FIGS. 5 to 12(*b*) which effects the casting operation through the four intermittent rotations from the stopping positions (I)′ to (II)′, (III)′, (IV)′ and (V)′ is capable of achieving a sufficient cooling time, while the production efficiency is further improved, since the intermittent rotation cycle can be advantageously reduced.

Since the other parts, functions and effects of the arrangement of FIGS. 5 to 12(*b*) are generally similar to those of the arrangement of FIGS. 1 to 4, the detailed description thereof is omitted here for brevity.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A casting apparatus for casting spherical metal lumps which comprises: a support frame; an upright rotary member rotatably supported on said support frame; said rotary member being rotatable past an odd number of at least five stopping positions spaced at equal intervals around the circumference of said rotary member and including an upper stopping position at the top of said rotary member and a lower stopping position at the bottom of said rotary member and spaced in the direction of rotation from said upper stopping position by an odd plurality of stopping positions; a plurality of casting mold means, one for each stopping position, extending radially outwardly from said rotary member and each including a pair of mold portions divided in a radial direction and defining at least one spherical cavity therein and a corresponding short pouring gate extending outwardly from and communicated with said spherical cavity, said pair of mold portions being pivotally connected at base portions thereof to said rotary member for being opened and closed by pivoting about said pivotal connections; means for successively closing said pair of mold portions at said upper stopping position and means for successively opening said mold portions at said lower stopping position; funnel means at said upper stopping position and positioned for communicating with the short pouring gates upon arrival of said mold portions at said upper stopping position during the intermittent rotation of said rotary member for pouring the molten metal into said spherical cavities, drive means comprising means for moving said rotary member in an uninterrupted movement through an angle equal to an even integral multiple of the angle between adjacent stopping positions at each portion of the intermittent rotation, said multiple being at least two; and means extending along part of the path of said short pouring gates immediately after said upper stopping position during intermittent rotation of said rotary member for closing said short pouring gates during intermittent movement of the rotary member.

2. A casting apparatus as claimed in claim 1 wherein there are five stopping positions spaced at angles 72° to provide first, second, third, fourth and fifth stopping positions each spaced 144° from the preceding stopping position, said first stopping position and said fifth stopping position being said upper stopping position and said lower stopping position, respectively, and said drive means comprises means for moving said member through an angle of 144° at each portion of the intermittent rotation.

3. A casting apparatus as claimed in claim 1 further comprising a mold portion retaining member for normally holding the mold portions in a closed state, and means for engaging said mold portion retaining member with said mold portions when they are in the upper stopping position and for disengaging said mold portion retaining member from said mold portions when they reach said lower stopping position.

4. A casting apparatus for casting spherical metal lumps which comprises:

a support frame;

an upright rotary member rotatably supported on said support frame;

said rotary member being rotatable past an odd number of at least five stopping positions spaced around the circumference of said rotary member and including an upper stopping position at the top of said rotary member and a lower stopping position at the bottom of said rotary member and spaced in the direction of rotation from said upper stopping position by an odd plurality of stopping positions;

a plurality of casting molds, one for each stopping position, extending radially outwardly from said rotary member and each including a pair of mold portions divided in a radial direction and defining at least one spherical cavity therein and a corresponding short pouring gate extending outwardly from and communicated with said spherical cavity, said pair of mold portions being pivotally connected at base portions thereof to said rotary member for being opened and closed by pivoting about said pivotal connections;

an open and close control member connected to said mold portions for closing successive pairs of mold portions at a stopping position immediately prior to said upper stopping position and at said upper stopping position and for opening the successive pairs of mold portions at said lower stopping position, a metal pouring funnel fixedly positioned at said upper stopping position and successively communicated with the short pouring gates in the pairs of mold portions moved to the upper stopping position for pouring molten metal into said cavities; drive means comprising means for moving said rotary member in an uninterrupted movement through an angle equal to an even integral multiple of the angle between adjacent stopping positions at each portion of the intermittent rotation, said multiple being at least two; and means extending along part of the path of said short pouring gates immediately after said upper stopping position during intermittent rotation of said rotary member for closing said short pouring gates during intermittent movement of the rotary member.

5. A casting apparatus as claimed in claim 4 in which said means for closing said short pouring gates comprises an arcuate wall extending along the path of the short pouring gates after they are moved away from said upper stopping position and engaged by the portion of said mold portions defining said short pouring gates for closing said short pouring gates.

6. A casting apparatus as claimed in claim 4 in which said means for closing said short pouring gates comprises an arcuate belt movable along the path of the short pouring gates after they are moved away from said upper stopping position and engaging the portion of said mold portions defining said short pouring gates for closing said short pouring gates.

7. A casting apparatus for casting spherical metal lumps which comprises:

a support frame;

an upright rotary member rotatably supported on said support frame and being rotatable past an odd number of at least five stopping positions spaced at equal intervals around the circumference of said rotary member and including an upper stopping position at the top of said rotary member and a lower stopping position at the bottom of said rotary member and spaced in the direction of rotation from said upper stopping position by an odd plurality of stopping positions;

a plurality of casting molds, one for each stopping position, extending radially outwardly from said rotary member and each including a pair of mold portions divided in a radial direction and defining at least one spherical cavity therein and a corresponding short pouring gate extending outwardly from and communicated with said spherical cavity, said pair of mold portions being pivotally connected at base portions thereof to said rotary member for being opened and closed by pivoting about said pivotal connections;

means for closing successive pairs of mold portions at said upper stopping position and for opening the successive pairs of mold portions at said lower stopping position;

a metal pouring funnel fixedly positioned at said upper stopping position and successively communicated with the short pouring gates in the pairs of mold portions moved to the upper stopping position for pouring molten metal into said cavities; and drive means for driving said rotary member in intermittent rotation and for moving said rotary member in an uninterrupted movement through an angle equal to an even intergral multiple of the angle between adjacent stopping positions at each portion of the intermittent rotation, said multiple being at least two, whereby said rotary member must be moved through more than one complete rotation for moving a particular mold means from said upper stopping position and stopping said particular mold means at said lower stopping position after a plurality of portions of the intermittent rotation.

8. A casting apparatus as claimed in claim 7 wherein there are five stopping positions spaced at angles 72° to provide first, second, third, fourth and fifth stopping positions each spaced 144° from the preceding stopping position, said first stopping position and said fifth stopping position being said upper stopping position and said lower stopping position, respectively, and said drive means comprises means for moving said member through an angle of 144° at each portion of the intermittent rotation.

9. A method of operating a casting apparatus for casting spherical metal lumps, which apparatus has a support frame, an upright rotary member rotatably supported on said support frame, said rotary member having an odd number of at least five stopping positions spaced at equal intervals around the circumference of said rotary member and including an upper stopping position at the top of said rotary member and a lower stopping position at the bottom of said rotary member and spaced in the direction of rotation from said upper stopping position by an odd plurality of stopping positions; a plurality of casting mold means, one for each stopping position, extending radially outwardly from said rotary member and each including a pair of mold portions divided in a radial direction and defining at least one spherical cavity therein and a corresponding short pouring gate extending outwardly from and communicated with said spherical cavity, said pair of mold portions being pivotally connected at base portions thereof to said rotary member for being opened and closed by pivoting about said pivotal connections; said method comprising intermittently moving said rotary member, each movement being an uninterrupted movement through an angle equal to an even integral multiple of the angle between adjacent stopping positions, said multiple being at least two for moving said pairs of mold portions to successive stopping positions, and each time an empty pair of mold portions stops at said upper stopping position, filling the thus stopped mold portions with molten metal, and each time a pair of mold portions with a cast metal lump therein stops at the lower stopping position, opening the thus stopped pair of mold portions for discharging the cast metal lump, whereby a filled pair of mold members will always make more than one complete rotation before arriving at said lower stopping position.

10. The method as claimed in claim 9 wherein there are five stopping positions spaced at angles of 72° to provide first, second, third, fourth and fifth stopping positions each spaced 144° from the preceding stopping postion, said first stopping position and said fifth stopping position being said upper stopping position and said lower stopping position, respectively, each movement is an uninterrupted movement through an angle of 144°.

11. The method as claimed in claim 9 further comprising closing the pouring gates of said pairs of molding members from the time the rotary member starts to move a pair of filled molding members from the upper stopping position to a position at least part way around the rotary member.

* * * * *